United States Patent [19]

Calder, Jr.

[11] 4,166,418

[45] Sep. 4, 1979

[54] TIME DELAY PRIMER AND METHOD OF MAKING SAME

[75] Inventor: Brooke J. Calder, Jr., Aurora, Ohio

[73] Assignee: Austin Powder Company, Beachwood, Ohio

[21] Appl. No.: 799,548

[22] Filed: May 23, 1977

[51] Int. Cl.[2] ..... F42B 3/10

[52] U.S. Cl. ..... 102/24 R; 102/27 R

[58] Field of Search ..... 102/22–24 R, 102/27 R

[56] References Cited

U.S. PATENT DOCUMENTS

| | | | |
|---|---|---|---|
| 2,736,263 | 2/1956 | Lewis et al. | 102/27 R |
| 4,060,033 | 11/1977 | Postupack et al. | 102/27 R |
| 4,060,034 | 11/1977 | Bowman | 102/27 R |

FOREIGN PATENT DOCUMENTS

| | | | |
|---|---|---|---|
| 663864 | 5/1963 | Canada | 102/24 R |

*Primary Examiner*—Verlin R. Pendegrass

*Attorney, Agent, or Firm*—Meyer, Tilberry & Body

[57] ABSTRACT

An improved delay primer unit for detonating an explosive material in a borehole with a detonating cord down line extending into the borehole. The primer comprises an explosive element capable of detonating the explosive material upon being detonated, means for preventing direct detonation of the explosive element by the down line, a time delay detonating element extending between the down line and the explosive element with a known detonation time delay value between first and second ends of the delay element, means slidably associating the first end with the down line and means for connecting the second end in detonation relationship with the explosive element. The improvement in this type of unit is the provision of the explosive element as a support element and a detonating cord wrapped around the support element to form a primer.

2 Claims, 4 Drawing Figures

TIME DELAY PRIMER AND METHOD OF MAKING SAME

The present invention relates to the art of detonating explosive materials in a borehole and more particularly to an improved time delay primer unit for detonating an explosive charge in a borehole.

BACKGROUND OF INVENTION

In using explosives to dislodge or heave material such as in a quarry, it is quite common practice to drill a number of boreholes, charge the boreholes with explosive material such as ANFO or ammonium nitrate slurry, and then detonate the explosure material in the boreholes in sequence to produce the desired movement of material. Since material of the type used in boreholes generally requires an intermediate primer of high explosive material for detonation, various arrangements have been used for priming the boreholes for detonation.

A common arrangement is to secure a detonating cord through the normal opening in a primer and drop the primer and cord to the lower portion of the borehole. Thereafter, explosive material is placed into the borehole or the borehole is filled further with explosive material. In some instances, the borehole is provided with several sections of explosive material separated by non-explosive material, such as soil. In these instances, a primer is generally required for each of the separate explosive charges. To accomplish this, as each section of charged explosive material is deposited, a primer is dropped down along the detonating cord forming the down line. After several charges are in place and primed, the same detonating cord can be used to explode all the primers simultaneously. This simultaneously explodes each of the various explosive charges within the borehole to provide maximum heave of the material being moved. These concepts of charging and priming boreholes with standard, available primers are well known and extensively used in the field.

In some instances, maximum earth movement can be accomplished by exploding or detonating various boreholes at different intervals during a single detonation. To accomplish this, the trunk lines used to detonate several detonating cords of different boreholes are interconnected by time delay devices. Thus, one group of boreholes controlled by one trunk line can be detonated at a slightly different time than another group of boreholes connected to a separate trunk line. These time delay connections take a variety of forms. Most commonly, they involve a time delay cartridge which is generally cylindrical and has internal structure which delays the propagation of a detonation wave therethrough for a preselected time. These cartridges are often connected at opposite ends to a relatively short section of commercial detonating cord. Thus, to interconnect two trunk lines for different detonating times, one of the time delay detonating cord sections is secured to one trunk line and the other detonating cord section is secured to the other trunk line. During detonation of one trunk line, there is a time delay until detonation of the next trunk line. Also, there are one piece molded time delay couplings which can be connected between somewhat standard detonating cords to provide the same preselected time delay. These cartridges or couplings are well known in the art and can be timed for delays of approximately 5 milliseconds to upwardly of several seconds. Indeed, some time delays are rated at zero time delays and they are often used for a connection between a primer and a low energy type of detonating cord, such as a detonating cord having a grain loading of less than about 10 grains per linear foot. Also, such zero time delay devices can be used with low energy detonating cord of the type having a hollow tube with an inner cylindrical wall coated by explosive material or filled with a combustible gas. In all instances, the time delay devices provide a preselected time shift from the somewhat instantaneous detonation occurring in a detonating cord. The availability and use of these various time delay devices used with detonating cords are well known. In addition, some time delay devices may be used with electrical caps which can be used to explode the high explosive of a primer for detonating the charge in a borehole at a preselected time after an electrical signal.

In recent years, governmental regulations have been adopted which affect the use of explosives of the type described above. One of these regulations, which is becoming quite common, limits the amount of explosive material which can be detonated at any given time within a certain distance from an inhabited building or from a highway or public transportation artery. This regulation has caused certain modifications in the blasting techniques used in congested areas or in areas adjacent specific structures. Compliance with these regulations has resulted in the adoption of the concept of detonating the material in a borehole at different times to prevent a violation of regulations regarding the amount of explosives that can be detonated at any given time. The first attempt to provide a means of detonating several axially spaced explosive charges in a given borehole at different and distinct times has been the use of separate time delay electrical caps for detonating the primer in each of the different axially spaced explosive charges in a single borehole. This procedure involved the conversion of the detonating system into an electrical system. As is well known, there are certain environments in which an electrical system is not acceptable or completely satisfactory. For instance, when electrical equipment is being used in the vicinity or during electrical storms. When electrical lines are laid for a detonation, these lines can act as an antenna and can be actuated in some unusual situations by electromagnetic waves, such as radio waves. Also, many users are well accustomed to detonating cord and somewhat hesitant to replace such systems with electrical systems to comply with governmental regulations. Thus, there is a substantial amount of effort devoted to the modification of the detonating cord system into a system which will comply with regulations and provide sequential detonation of separate charges axially spaced within a single borehole. One of the most common systems is to provide a separate time delay cartridge in the detonating cord extending to each of several primers within the borehole. This requires the use of separate and distinct down lines extending to the different primers at axially spaced positions within the borehole. This type of arrangement is time consuming and costly. Another arrangement is to provide time delay cartridges at the primers themselves and use several low energy detonating cords extending from the upper trunk line to the separate primers within a given borehole. This concept is not substantially different from the concept of using time delay devices in the down line itself since separate and distinct down lines are required for each primer to produce the time delay required for sequential detonation of the axially spaced charges.

Prior to the present invention, an improved primer unit has been developed for exploding spaced charges in a borehole. This delay primer unit is disclosed in prior application Ser. No. 740,799, filed Nov. 11, 1976, which is incorporated by reference herein as background information. In accordance with the disclosure of this prior application, an explosive element, or primer, can be moved along a down line formed from a detonating cord and detonated at a time delay value after the down line by an interconnecting time delay element. Thus, each of these units can be positioned with axially spaced explosive charges to provide serially detonated explosive charges in a borehole. This prior concept utilizes a single detonating cord for detonating the various explosive charges in time series. The present invention relates to an improvement in this prior time delay primer unit which does not require the use of a cast primer or other preformed primer as shown in the preferred embodiment of the prior application.

INVENTION

In accordance with the present invention, there is provided an improvement in a time delay primer unit of the type described above, which improvement includes a support element and a standard detonating cord wrapped around the support element to form the primer of the time delay primer unit. In this manner, a length of detonating cord connected to the output side of a time delay element can be provided with sufficient length that it can be wrapped around the support element to form the explosive element of the delay primer. This allows assembly of a delay primer in the field which incorporates a time delay feature to cause serial detonation of spaced explosive charges in a borehole.

The primary object of the present invention is the provision of an improved time delay primer unit which unit does not require a cast primer and which can be assembled in the field having only a support element and a time delay element of somewhat standard structure.

Still a further object of the present invention is the provision of a time delay primer unit, as described above, which unit is inexpensive to manufacture and effective in use.

These and other objects and advantages will become apparent from the following description taken together with the accompanying drawings.

PREFERRED EMBODIMENT

Figure 3:
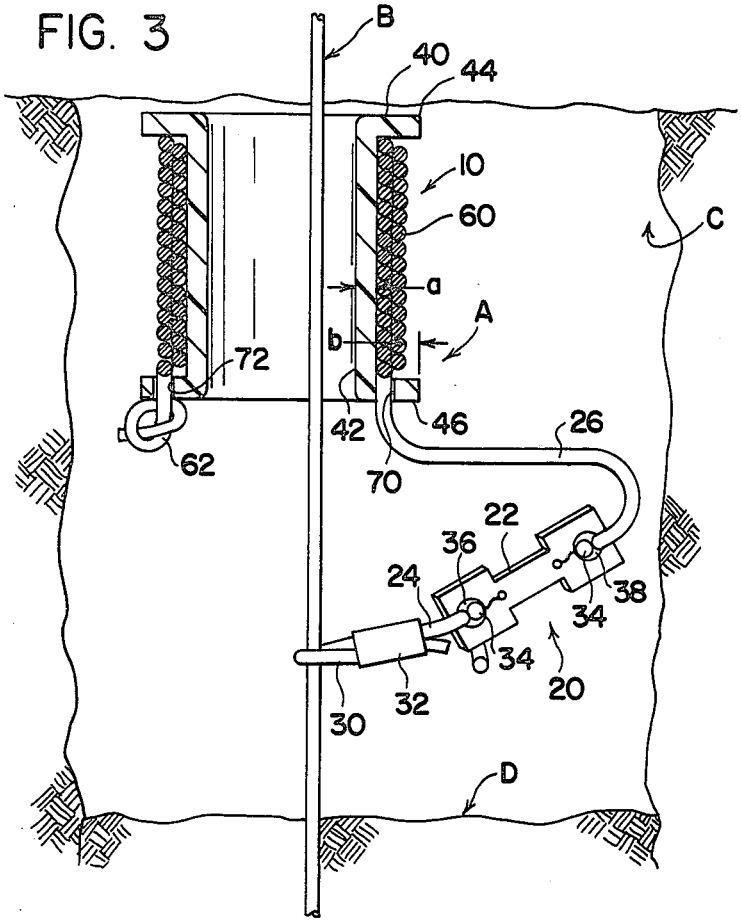
FIG. 3 is a partial cross-sectional view illustrating a preferred embodiment of the invention as shown in FIG. 1 with a slight modification in the manner in which it is assembled on the down line; and, FIG. 4 is a cross-sectional view showing a modification of the preferred embodiment as illustrated in FIGS. 1-3.
Figure 1:
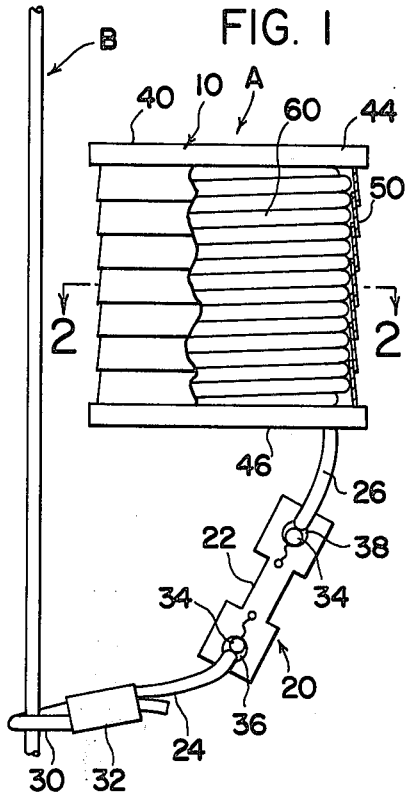
FIG. 1 is a somewhat schematic side elevational view showing the preferred embodiment of the present invention.
Figure 2:
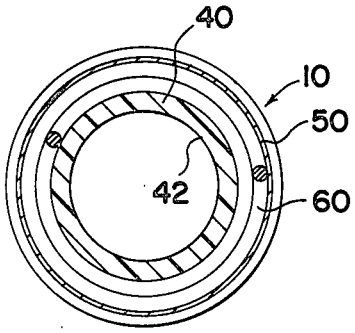
FIG. 2 is a cross-sectional view taken generally along line 2—2 of FIG. 1.

Referring now to the drawings wherein the showings are for the purpose of illustrating a preferred embodiment of the invention only, and not for the purpose of limiting same, time delay primer unit A is slidably secured onto a down line B extending into a borehole C which is provided with alternate layers of explosive material, such as ANFO or ammonium nitrate slurry. These charges are separated by material, such as earth barrier or wall D. Down line B is a standard down line having a loading of approximately 30-60 grains per linear foot of high explosive material, such as PETN. This cord is detonated at one end of the down line to detonate the spaced explosive charges within borehole C. To provide a different time for detonation of the different charges within borehole C, there is provided a novel delay primer unit A. This primer unit includes a primer of explosive element 10 which, when detonated, will detonate one of the charges of explosive material within borehole C. The explosive material is immune to detonation by the energy developed during detonation of the detonating cord forming down line B. Delay primer unit A includes a flexible time delay element 20 formed from a time delay unit 22 having a selected time delay value in accordance with standard practice, a first length of detonating cord 24 secured to one end of the time delay unit and a second length of detonating cord 26 secured to the opposite end of the time delay unit. In this manner, detonation of cord 24 causes detonation of cord 26 at a time delay determined by the value assigned to delay unit 22, which value may vary from a few microseconds, such as five microseconds, to several seconds. This type of time delay unit is well known in the field and is produced by DuPont Company of Wilmington, Delaware. Detonating cords 24, 26 are formed from standard detonating cord material and have a grain loading similar to the loading of down line B and a truck line which may be used to detonate the down line. Of course, cord 24 could be of a lower energy value as long as it will initiate the time delay unit 22. The first length of detonating cord 24 is slidably connected to down line B by any arrangement which can be a loop 30 held by standard detonating cord clip or coupling 32. In this manner, detonation of the cord forming down line B will detonate cord 24, which, in turn, will detonate cord 26 after a time delay determined by unit 22. In accordance with standard practice, pins 34 hold detonating cords 24, 26 in detonating relationship with unit 22 in spaced holes 36, 38. As so far described, loop 30 is formed so that time delay primer unit A can be secured in sliding relationship on down line B. Unit A may be dropped or shifted into a proper position for detonation of a selected explosive charge at a time spacing with respect to detonation of cord B. In this type of unit, it is necessary to prevent direct detonation of primer 10 by down line B. This can be done by maintaining a spacing between the primer 10 and down line B. Such spacing can be reduced by providing some type of insulating barrier between the primer 10 and the down line. In accordance with the invention, primer 10 includes a support means in the form of a spool 40 having a cylindrical wall 42 and axially spaced flanges 44, 46. If primer 10 is used as shown in FIG. 1, flanges 44, 46 and a barrier formed by wrapped tape 50 prevent detonation of primer 10 directly by detonation of down line B. If primer 10 is positioned as shown in FIG. 3, cylindrical wall 42 insulates primer 10 from detonation directly by down line B. As shown in FIG. 3, the spacing a is sufficient to prevent detonation by cord B. In a like manner, the spacing b is such that, combined with layer 50 of wrapped tape, it prevents detonation of primer 10 by down line B when primer 10 is dropped into the borehole in the manner shown in FIG. 1.

As so far described, except for support means on spool 40, time delay primer unit A does not differ substantially from time delay units of the type shown in prior application Ser. No. 740,799, filed Nov. 11, 1976. In accordance with the present invention, this type of time delay unit is improved by forming primer 10 as a wrapped core 60 formed from standard detonating cord which is wrapped around spool 40 between flanges 44, 46. In the preferred embodiment, detonating cord 26 is elongated and integral with the cord forming core 60. In practice, detonating cord 26 has a substantial length and is threaded through opening 70 in flange 46. Cord 26 is then wrapped into convolutions around wall 42 until the desired amount of explosive material formed by the detonating cord is provided between flanges 44, 46. Thereafter, one end of the detonating cord is passed through opening 72 in flange 46 where it is tied into knot 62 completing core 60. If the primer unit is to be used in the manner shown in FIG. 1, tape layer 50 is provided around the exterior of core 60 to form an additional detonation insulating barrier between down line B and explosive element or core 60. Consequently, primer 10 or core 60 and loop 30 can be formed in the field with standard detonating cord having only a standard clip 32 and a standard time delay unit 22. In this manner, a plurality of different time delays can be provided in a single borehole which time delays have a value determined by selection of the appropriate time delay value in unit 22. This gives time spaced detonation of axially spaced explosive charges in borehole C.

Figure 4:
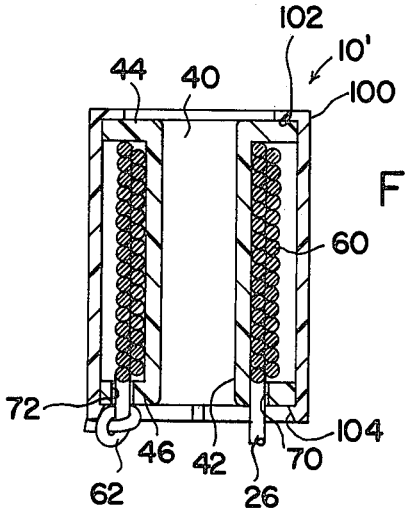

In accordance with the modification of the preferred embodiment, primer 10′ shown in FIG. 4 includes an insulating casing 100 telescoped over flanges 44, 46 of spool 40. This replaces tape layer 50 and provides a well insulated primer for use in either the fashion shown in FIG. 1 or in the fashion shown in FIG. 3. Upper shoulder 102 engages flange 44 and lower segmented shoulder 104 snaps over flange 46 to complete assembly of cover 100 onto spool 40. Consequently, the delayed primer shown in FIGS. 1 and 3 can be assembled in the field with only the provision of spool 40 and maybe casing 100 with other standard detonating accessories.

In some instances, element 22 could be slidably connected on down line B by passing the down line through hole 36. This would eliminate the need for cord 24.

Having thus defined the invention, it is claimed:

1. In a delay primer unit for detonating an explosive material in a borehole with a detonating cord down line extending into said borehole, said primer unit comprising: an explosive element capable of detonating said explosive material upon being detonated; means for preventing direct detonation of said explosive element by said down line; a time delay detonating element extending between said down line and said explosive element with a known detonation time delay value between first and second ends of said delay element; first means slidably associating said first end with said down line; and, second means for connecting said second end in detonation relationship with said explosive element, the improvement comprising: said explosive element including a generally cylindrical support element and a detonating cord wrapped in several convolutions around said support element to form a primer; and, said second means being a length of detonating cord extending from said second end to said wrapped detonating cord, said support element being a spool having an inner cylindrical wall around which said primer forming detonating cord is wrapped, said wall forming said preventing means.

2. In a delay primer unit for detonating an explosive material in a borehole with a detonating cord down line extending into said borehole, said primer unit comprising: an explosive element capable of detonating said explosive material upon being detonated; means for preventing direct detonation of said explosive element by said down line; a time delay detonating element extending between said down line and said explosive element with a known detonation time delay value between first and second ends of said delay element; first means slidably associating said first end with said down line; and, second means for connecting said second end in detonation relationship with said explosive element, the improvement comprising: said explosive element including a generally cylindrical support element and a detonating cord wrapped in several convolutions around said support element to form a primer; and, said second means being a length of detonating cord extending from said second end to said wrapped detonating cord, said support element including means for maintaining said primer spaced radially from said down line.

* * * * *